US008998571B2

(12) United States Patent
Burdgick et al.

(10) Patent No.: US 8,998,571 B2
(45) Date of Patent: Apr. 7, 2015

(54) SLOTTED TURBINE AIRFOIL

(75) Inventors: Steven Sebastian Burdgick, Schenectady, NY (US); Alberto Di Sante, Fano (IT)

(73) Assignee: General Electric Company, Schenectady, NY (US)

( * ) Notice: Subject to any disclaimer, the term of this patent is extended or adjusted under 35 U.S.C. 154(b) by 472 days.

(21) Appl. No.: 13/454,757

(22) Filed: Apr. 24, 2012

(65) Prior Publication Data

US 2013/0177397 A1 Jul. 11, 2013

(30) Foreign Application Priority Data

Jan. 5, 2012 (IT) ..... MI12A0010

(51) Int. Cl.
*F01D 9/02* (2006.01)
*F01D 9/04* (2006.01)
*F01D 5/18* (2006.01)

(52) U.S. Cl.
CPC ..... *F01D 5/187* (2013.01); *F05B 2230/232* (2013.01); *F05B 2260/95* (2013.01)

(58) Field of Classification Search
CPC . F01D 5/187; F05B 2230/232; F05B 2260/95
USPC ..... 415/115, 116; 416/97 A, 96 R, 96 A
See application file for complete search history.

(56) References Cited

U.S. PATENT DOCUMENTS 3,111,302 A 11/1963 Bowmer
3,420,502 A 1/1969 Howald
3,881,842 A 5/1975 Kosyak et al.
4,025,226 A * 5/1977 Hovan ..... 415/115
4,137,462 A 1/1979 Wyler
5,931,638 A * 8/1999 Krause et al. ..... 416/97 R
6,234,754 B1 * 5/2001 Zelesky et al. ..... 416/97 R
7,422,415 B2 9/2008 Burdgick et al.
7,762,775 B1 7/2010 Liang
7,780,415 B2 * 8/2010 Liang ..... 416/97 R
7,946,815 B2 * 5/2011 Liang ..... 416/97 R
8,096,771 B2 * 1/2012 Liang ..... 416/97 R
2006/0133936 A1 6/2006 Papple

FOREIGN PATENT DOCUMENTS

WO 0227147 A1 4/2002

OTHER PUBLICATIONS

Search Report and Written Opinion from IT Application No. MI2012A000010 dated Aug. 23, 2012.

* cited by examiner

*Primary Examiner* — Igor Kershteyn
(74) *Attorney, Agent, or Firm* — Hoffman Warnick LLC; Ernest G. Cusick

(57) ABSTRACT

A slotted turbine static nozzle airfoil. In one embodiment, the turbine static nozzle airfoil includes a concave pressure wall having a slot extending therethrough; a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment configured to extend the pocket toward a trailing edge of the turbine static nozzle airfoil.

13 Claims, 3 Drawing Sheets

SLOTTED TURBINE AIRFOIL

BACKGROUND OF THE INVENTION

The subject matter disclosed herein relates to a slotted turbine airfoil. More particularly, aspects of the invention include a turbine airfoil having a moisture diverting slot for increasing the efficiency of a turbine stage including that airfoil.

In some stages of a turbine (e.g., the last stages of a low-pressure steam turbine section), the high speed and local wetness concentration of steam passing through these stages can erode the tip regions of rotating buckets, as well as the walls of the static nozzle airfoils. In order to combat the erosive effects of the steam in this region, manufacturers conventionally harden the bucket airfoil leading edges near the tip region, or shield the area with satellite strips. Another conventional approach involves removing accumulated water through water drainage arrangements in the nozzle outer sidewalls (or, endwalls), or through pressure and/or suction slots made in hollow static nozzle airfoils. This moisture is then collected in circumferential cavities between the turbine diaphragm and the turbine casing, which then drains to the condenser or other suitable pressure dump (or, chamber). However, both of these conventional approaches have respective downsides. In the case of hardening or shielding, the costs associated with such protection can be significant. In the case of conventional hollow airfoils with pressure or suction slots, theses airfoils and slots can be difficult to manufacture, and can be difficult to weld into the turbine diaphragm rings without causing distortion in the airfoil.

BRIEF DESCRIPTION OF THE INVENTION

A slotted turbine static nozzle airfoil is disclosed. In one embodiment, the turbine static nozzle airfoil includes a concave pressure wall having a slot extending therethrough; a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment configured to extend the pocket toward a trailing edge of the turbine static nozzle airfoil.

A first aspect of the invention includes a turbine static nozzle airfoil having: a concave pressure wall having a slot extending therethrough; a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment configured to extend the pocket toward a trailing edge of the turbine static nozzle airfoil.

A second aspect of the invention includes a turbine stator comprising: axially dispersed sets of nozzles for directing a working fluid, wherein one of the axially dispersed sets of nozzles includes a plurality of turbine static nozzle airfoils, each of the turbine static nozzle airfoils having: a concave pressure wall having a slot extending therethrough; a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment configured to extend the pocket toward a trailing edge of the turbine static nozzle airfoil.

A third aspect of the invention includes a turbine static nozzle comprising: a pair of endwalls; and a nozzle airfoil dispersed between and connected with each of the pair of endwalls, the nozzle airfoil including: a concave pressure wall having a slot extending therethrough; a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment configured to extend the pocket toward a trailing edge of the turbine static nozzle airfoil.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
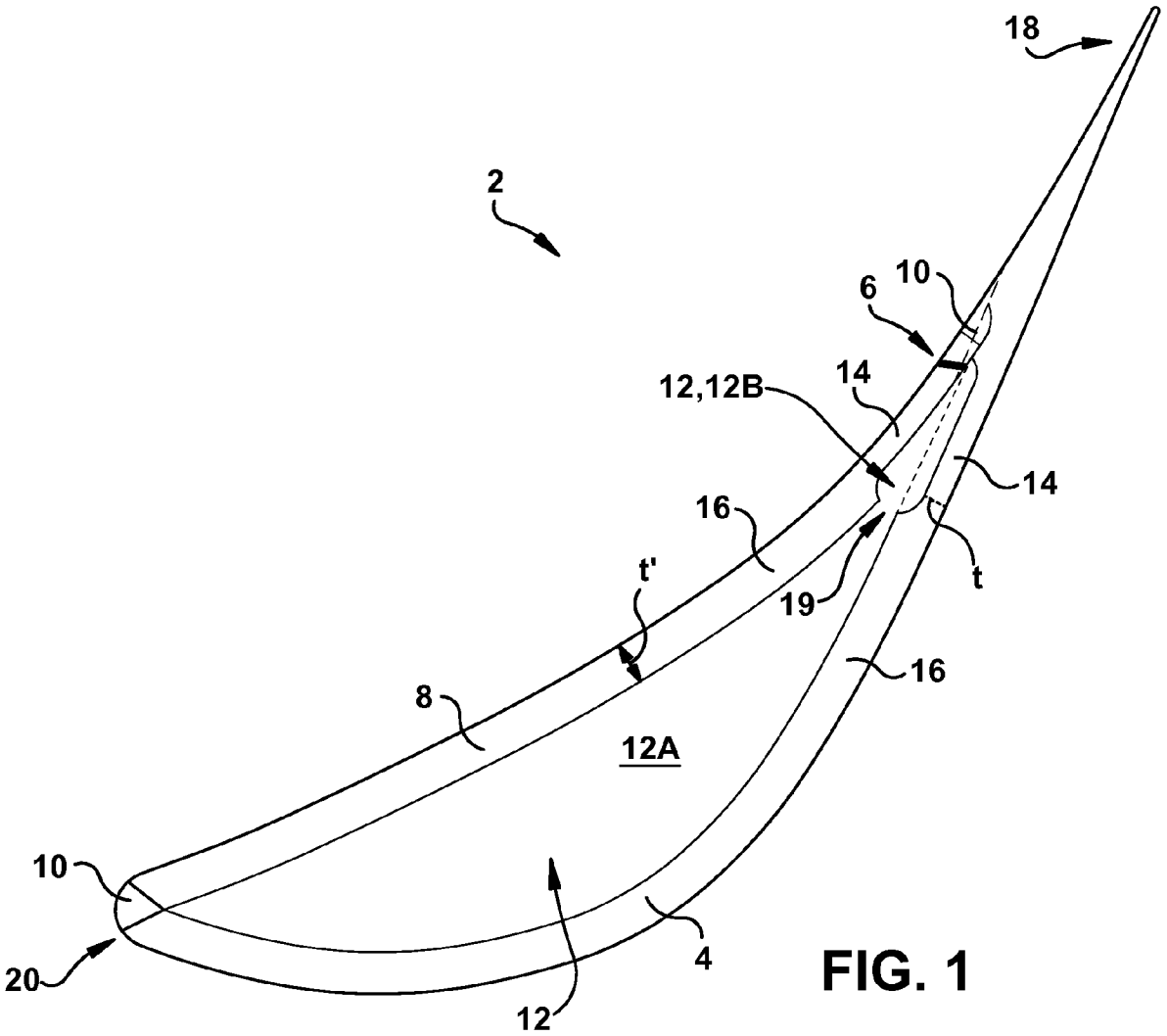
FIG. 1 shows a side cross-sectional view of a nozzle airfoil according to aspects of the invention.

The subject matter disclosed herein relates to a slotted turbine airfoil. More particularly, aspects of the invention include a turbine airfoil having a moisture diverting slot for increasing the efficiency of a turbine stage including that airfoil.

In some stages of a turbine (e.g., the last stages of a low-pressure steam turbine section), the high speed and local wetness concentration of steam passing through these stages can erode the tip regions of rotating buckets, as well as the walls of the static nozzle airfoils. In order to combat the erosive effects of the steam in this region, manufacturers conventionally harden the bucket airfoil leading edges near the tip region, or shield the area with satellite strips. Another conventional approach involves removing accumulated water through water drainage arrangements in the nozzle outer sidewalls (or, endwalls), or through pressure and/or suction slots made in hollow static nozzle airfoils. This moisture is then collected in circumferential cavities between the turbine diaphragm and the turbine casing, which then drains to the condenser or other suitable pressure dump (or, chamber). However, both of these conventional approaches have respective downsides. In the case of hardening or shielding, the costs associated with such protection can be significant. In the case of conventional hollow airfoils with pressure or suction slots, theses airfoils and slots can be difficult to manufacture, and can be difficult to weld into the turbine diaphragm rings without causing distortion in the airfoil.

Moisture removal stages in the low pressure (LP) section of a steam turbine serve a couple of beneficial purposes. Removing moisture from the section reduces the erosion on the last stage rotating bucket. This prolongs the life of the bucket as well as preserves the profile shape of the bucket. Additionally, moisture removal improves performance by removing moisture droplets that can negatively affect the steam trajectory impacting the buckets. Poor steam trajectory can lead to reduced stage efficiency.

As noted herein, prior attempts at moisture removal in the static nozzle assemblies of LP turbines are deficient in a number of ways. The prior "thin-walled" design, where the walls of the turbine nozzle airfoil have a uniform thickness of approximately 4 millimeters (mm), allow for placement of the moisture removal slot proximate the trailing edge of the turbine airfoil. While the location of the slot in this "thin-walled" design helps to remove moisture from the face of the nozzle airfoil (as it is significantly downstream of the leading edge), the "thin walled" design is prone to manufacturability issues such as distortion due to the thinness of its walls. This distortion can lead to poor aerodynamic profiles, and can further distort welding of the final diaphragm assembly, which negatively affects turbine performance. In contrast, the prior art "thick-walled" design, having turbine nozzle airfoil walls with a thickness of approximately 6-8 mm, are subject to less distortion than the "thin-walled" designs, but require that the moisture removal slot be located closer to the leading edge of the airfoil. The location of the slot in this design is less effective in moisture removal.

In contrast to these prior designs, aspects of the invention include a turbine static nozzle airfoil having: a concave pressure wall having a slot extending therethrough; a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment configured to extend the pocket toward a trailing edge of the turbine static nozzle airfoil.

Turning to FIG. 1, a side cross-sectional view of a turbine static nozzle airfoil (or, airfoil) 2 is shown according to embodiments of the invention. As shown, the turbine static nozzle airfoil 2 can include a convex suction wall 4 and a concave pressure wall 8 having a slot 6 extending therethrough. The concave pressure wall 8 can be adjoined with the convex suction wall 4 at respective end joints 10 (e.g., welds). Also shown, the airfoil 2 can include a pocket 12 (specifically, sub-pocket 12B) fluidly connected with the slot 6 and located between the convex suction wall 4 and the concave pressure wall 8. More particularly, in some embodiments, the slot 6 fluidly connects to the sub-pocket 12B proximate a trailing edge 13 of the sub-pocket 12B. Additionally, at least one of the convex suction wall 4 or the concave pressure wall 8 includes a thinned segment 14, having a lesser thickness (t) than a remainder 16 (with thickness t') of the at least one of the convex suction wall 4 or the concave pressure wall 8. As will be described further herein, the thinned segment 14 is configured to extend the pocket 12 toward a trailing edge 18 of the turbine static nozzle airfoil 2 such that the slot 6 can be placed closer to that trailing edge 18 than in conventional moisture removal static nozzle airfoils. In some embodiments, the slot 6 extends through the thinned segment 14, e.g., when the thinned segment is located within the concave pressure wall 8.

FIG. 1 illustrates an embodiment (in phantom) where only the concave pressure wall 8 has a thinned segment 14, and the convex suction wall 4 has a substantially uniform thickness (as illustrated by the dashed line). It is understood that in another embodiment, illustrated in FIG. 2, only the convex suction wall 4 includes the thinned segment 14, and the concave pressure wall 8 can have a substantially uniform thickness (as illustrated by the dashed line in that Figure). That is, in some cases, only one of the convex suction wall 4 or the concave pressure wall 8 can include the thinned segment 14. In other cases, both of the convex suction wall 4 and concave pressure wall 8 can include the thinned segment 14. However, in any case, the thinned segment(s) 14 can extend the pocket 12 (forming sub-pocket 12B) toward the trailing edge 18. The thinned segment(s) 14 can define a neck 19 which forms sub-pockets 12A, 12B of pocket 12 between the convex suction wall 4 and the concave pressure wall 8.

As shown in FIG. 1, the thinned segment 14 can be located proximate one of the respective end joints 10 (e.g., welds) and the slot 6. In some cases, where the thinned segment 14 is located in the concave pressure wall 8, the slot 6 can be located within (or, extend through) the thinned segment 14 of the concave pressure wall 8. Additionally, the thinned segment 14 (and the slot 6) can be located proximate the trailing edge 18 of the airfoil 2. That is, the thinned segment 14 can abut (e.g., physically contact) the joint 10 (weld) located at the trailing edge 18 of the airfoil, where this joint 10 couples the convex suction wall 4 with the concave pressure wall 8. As compared with conventional approaches using a "thick-walled" design, the airfoil 2 disclosed herein allows for location of the slot 6 approximately ten to twenty percent closer to the trailing edge 18 along the concave pressure wall 8. Location of the slot 6 in this case allows for more efficient moisture removal across the concave pressure wall 8.

As shown, one or both of the convex suction wall 4 or the concave pressure wall 8 can include a thinned segment 14 having a lesser thickness (t) than a remainder 16 of the wall, where that remainder 16 has a second, larger thickness (t'). This second thickness (t') in some cases can be approximately 1.5 to two times the lesser thickness (t). This can allow for placement of the slot 6 closer to the trailing edge 18 than in the conventional thick-walled designs while still preventing the manufacturing issues associated with the thin-walled designs.

Figure 2:
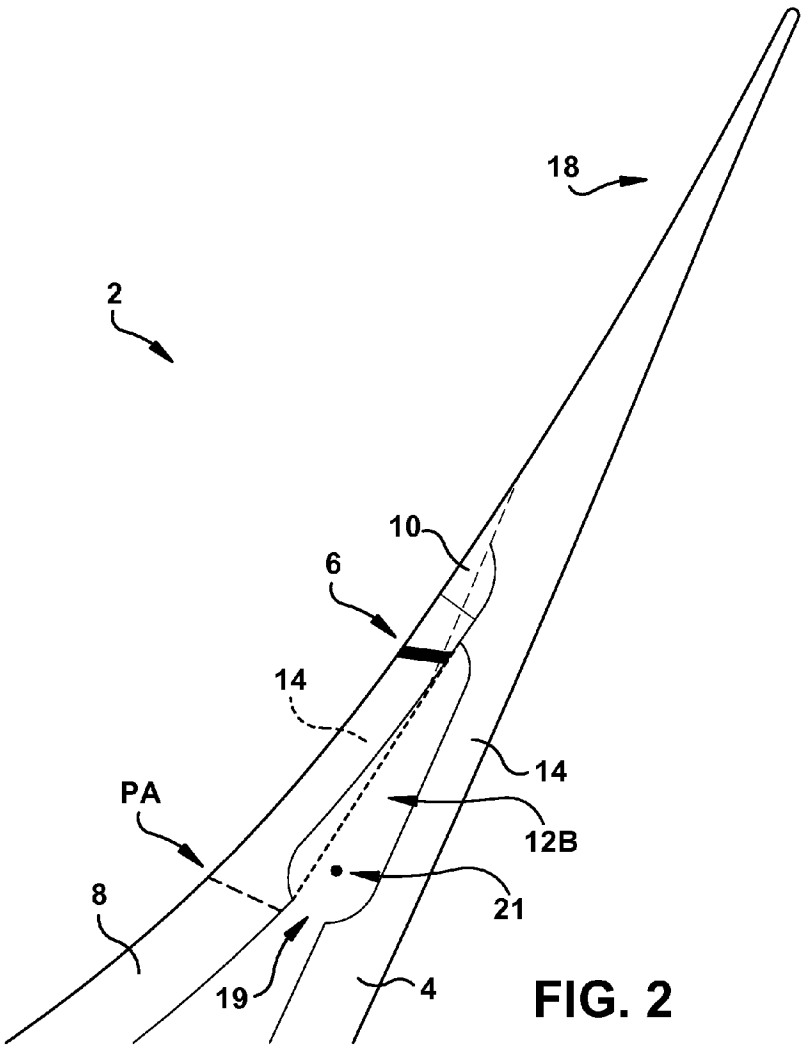
FIG. 2 shows a close-up side cross-sectional view of the nozzle airfoil of FIG. 1 according to aspects of the invention.

FIG. 2 shows a close-up side cross-sectional view of the airfoil 2 of FIG. 1, which more clearly illustrates the relationship between the slot 6 and the thinned segment(s) 14. As shown in this view, the thinned segment 14 allows for placement of the slot 6 closer to the trailing edge 18 than in the case where neither of the convex suction wall 4 nor the concave pressure wall 8 include a thinned segment 14 (as described with reference to the "thick-walled" example herein).

Also illustrated in FIG. 2 (in phantom) is the location of a moisture removal slot (or, prior art slot) PA according to the prior art "thick-walled" embodiments. As is evident from the depiction of the airfoil 2, the prior art slot PA is located farther from the trailing edge than the slot 6 formed according to embodiments of the invention. This is possible because of the thinned section 14 of at least one of the walls (4 or 8), which allows for placement of the slot 6 where a weld (such as end joint 10) would have previously been located. In some cases, the slot 6 in the airfoil 2 according to embodiments of the invention is located ten to twenty percent closer the trailing edge 18 than in the prior art "thick-walled" example. FIG. 2 further shows a pocket termination reference point 21, which illustrates a location where the prior art pocket would have terminated using the "thick-walled" design. This pocket termination reference point 21 represents a junction of two nozzle airfoil walls (according to the prior art), each excluding the thinned segment 14. That is, without the use of at least one thinned segment 14 shown and described herein, the pocket (e.g., pocket 12) would not extend beyond the pocket termination reference point 21 toward the trailing edge 18. As shown, this allows the slot 6 to fluidly communicate with the pocket 12 (e.g., sub-pocket 12B) at a location between the pocket termination reference point 21 and the trailing edge 13 of the pocket 12. In this case, as described herein with reference to the shortcomings of the "thick-walled" design, the prior art slot PA is located farther from the trailing edge 18, and is less effective in moisture removal. With respect to this pocket termination point 21, the thinned segment(s) 14 shown and disclosed herein extends the pocket (12) beyond the pocket termination point 21, allowing for formation of sub-pocket 12B and enhanced moisture removal as noted herein.

Manufacturing the airfoil 2 according to embodiments can include separately hydro-forming the respective convex suction wall 4 and the concave pressure wall 8, where at least one of the walls (4, 8) includes a thinned segment 14. After hydro-forming the walls (4, 8), those walls can be welded together at respective joints 10 (proximate leading edge 20, FIG. 1, and trailing edge 18, respectively) using a conventional welding technique such as gas tungsten arc welding (or, inert gas, TIG welding), gas metal arc welding (or, metal inert gas, MIG welding), etc. In another embodiment, the respective convex suction wall 4 and the concave pressure wall 8 can be molded, machined, or otherwise separately formed, and then welded together at respective joints 10. In any case, as compared with conventional airfoils, the airfoils 2 disclosed according to embodiments of the invention allow for placement of the slot 6 closer to the trailing edge 18 of the convex suction wall 4, thereby improving moisture removal in a turbine stage including one or more of these airfoil(s) 2.

Figure 3:
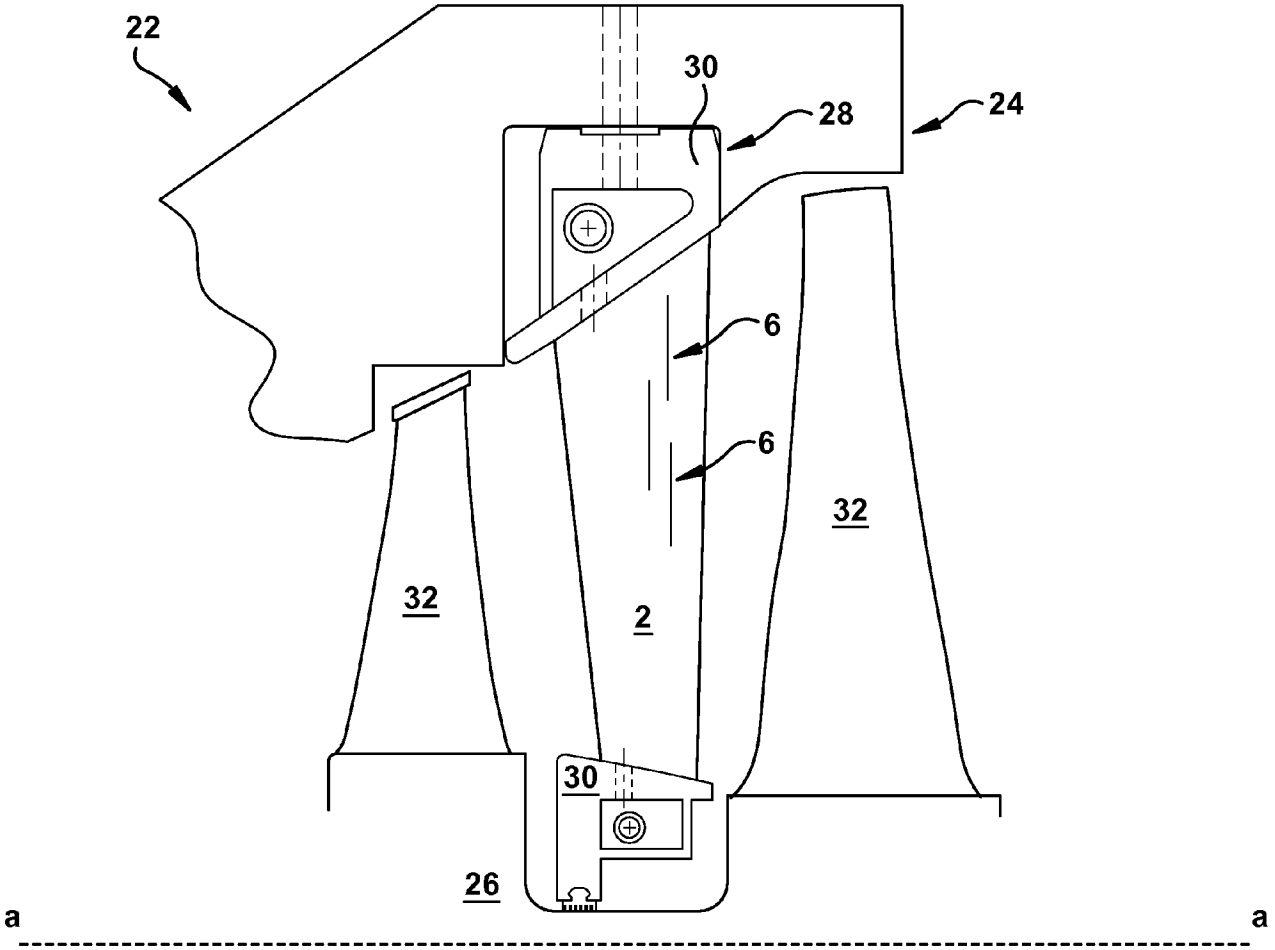
FIG. 3 shows a plan view of a portion of a turbine according to aspects of the invention.

FIG. 3 shows a plan view of a portion of a turbine 22 (e.g., a steam turbine such as a low pressure steam turbine section) according to aspects of the invention. As shown, the turbine 22 can include a turbine stator 24, which substantially surrounds a turbine rotor 26. The stator 24 can include axially dispersed sets of nozzles 28 (one set shown), where one or more of the axially dispersed sets of nozzles 28 can include a plurality of turbine static nozzle airfoils (e.g., airfoils 2 shown and described with reference to FIGS. 1-2). That is, in some embodiments, an entire set of nozzles 28 can include nozzle airfoils 2, and in some cases, a plurality of sets of nozzles 28 can include nozzle airfoils 2. In some cases, each turbine static nozzle 2 in the set of nozzles 28 can include a pair of endwalls 30 and the nozzle airfoil 2 dispersed between and connected with each of the pair of endwalls 30. As is known in the art, these turbine static nozzles 28 remain fixed within the stator 24 during operation of the turbine 22 and direct a working fluid toward rotating blades 32 of the rotor 26 to induce motion of the rotor's shaft (not shown, but aligned with axis a-a, as is known in the art). As described herein, at least one of these sets of nozzles 28 in the turbine 22 can be configured to remove moisture from the airfoil faces (concave pressure side 4) using one or more slots 6.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine static nozzle airfoil comprising:

a concave pressure wall having a slot extending there through;

a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment configured to extend the pocket toward a trailing edge of the turbine static nozzle airfoil, wherein the respective end joints include weld joints, and wherein a first one of the weld joints is located proximate a leading edge of the turbine static nozzle airfoil, and wherein a second one of the weld joints is located at the trailing edge of the turbine static nozzle airfoil, wherein the slot is located within the thinned segment that is proximate the trailing edge of the airfoil and abutting the second one of the weld joints, and wherein the slot extends entirely through the thinned segment only on the concave pressure wall.

2. The turbine static nozzle airfoil of claim 1, wherein both of the convex suction wall and the concave pressure wall include the thinned segment.

3. The turbine static nozzle airfoil of claim 1, wherein the thinned segment defines a neck within the pocket, the neck forming a sub-pocket between the convex suction wall and the concave pressure wall, wherein the slot fluidly connects to the sub-pocket proximate a trailing edge of the sub-pocket.

4. The turbine static nozzle airfoil of claim 1, wherein the thinned segment is configured to extend the pocket beyond a pocket termination reference point, the pocket termination reference point representing a junction of two nozzle airfoil walls each excluding the thinned segment.

5. The turbine static nozzle airfoil of claim 4, wherein the slot is configured to fluidly communicate with the pocket at a location between the pocket termination reference point and a trailing edge of the pocket.

6. The turbine static nozzle airfoil of claim 1, wherein a remainder of the at least one of the convex suction wall or the concave pressure wall has a thickness of approximately 1.5 to two times a thickness of the thinned segment.

7. A turbine stator comprising:

axially dispersed sets of nozzles for directing a working fluid, wherein one of the axially dispersed sets of nozzles includes a plurality of turbine static nozzle airfoils, each of the turbine static nozzle airfoils having:

a concave pressure wall having a slot extending therethrough;

a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment extending the pocket toward a trailing edge of the turbine static nozzle airfoil, wherein the respective end joints include weld joints, and wherein a first one of the weld joints is located proximate a leading edge of the turbine static nozzle airfoil, and wherein a second one of the weld joints is located at the trailing edge of the turbine static nozzle airfoil, wherein the slot is located within the thinned segment that is proximate the trailing edge of the airfoil and abutting the second one of the weld joints, and wherein the slot extends entirely through the thinned segment only on the concave pressure wall.

8. The turbine stator of claim 7, wherein both of the convex suction wall and the concave pressure wall include the thinned segment.

9. The turbine stator of claim 7, wherein the thinned segment defines a neck within the pocket, the neck forming a sub-pocket between the convex suction wall and the concave pressure wall.

10. The turbine stator of claim 7, wherein the thinned segment extends the pocket beyond a pocket termination point.

11. The turbine stator of claim 7, wherein a remainder of the at least one of the convex suction wall or the concave pressure wall has a thickness of approximately 1.5 to two times a thickness of the thinned segment.

12. A turbine static nozzle comprising:

a pair of endwalls; and a nozzle airfoil dispersed between and connected with each of the pair of endwalls, the nozzle airfoil including:

a concave pressure wall having a slot extending therethrough;

a convex suction wall adjoined with the concave pressure wall at respective end joints; and a pocket fluidly connected with the slot and located between the convex suction wall and the concave pressure wall, wherein at least one of the convex suction wall or the concave pressure wall includes a thinned segment proximate one of the respective end joints, the thinned segment extending the pocket toward a trailing edge of the turbine static nozzle airfoil, wherein the respective end joints include weld joints, and wherein a first one of the weld joints is located proximate a leading edge of the turbine static nozzle airfoil, and wherein a second one of the weld joints is located at the trailing edge of the turbine static nozzle airfoil, wherein the slot is located within the thinned segment that is proximate the trailing edge of the airfoil and abutting the second one of the weld joints, and wherein the slot extends entirely through the thinned segment only on the concave pressure wall.

13. The turbine static nozzle of claim 12, wherein both of the convex suction wall and the concave pressure wall include the thinned segment.

* * * * *